US010854177B2

(12) United States Patent
Lenz

(10) Patent No.: US 10,854,177 B2
(45) Date of Patent: Dec. 1, 2020

(54) NOISE MAKER STOP ASSEMBLY FOR USE WITH A PERCUSSION FOOT PEDAL

(71) Applicant: Michael Lenz, Pueblo West, CO (US)

(72) Inventor: Michael Lenz, Pueblo West, CO (US)

( * ) Notice: Subject to any disclaimer, the term of this patent is extended or adjusted under 35 U.S.C. 154(b) by 0 days.

(21) Appl. No.: 16/288,370

(22) Filed: Feb. 28, 2019

(65) Prior Publication Data

US 2019/0272809 A1 Sep. 5, 2019

Related U.S. Application Data

(60) Provisional application No. 62/636,893, filed on Mar. 1, 2018.

(51) Int. Cl.
*G10D 13/11* (2020.01)

(52) U.S. Cl.
CPC ..... *G10D 13/11* (2020.02)

(58) Field of Classification Search
CPC ..... G10D 13/006; G10D 13/06
See application file for complete search history.

(56) References Cited

U.S. PATENT DOCUMENTS

2005/0016358 A1* 1/2005 Wise ..... G10D 13/006 84/422.1
2005/0109191 A1 5/2005 Gusek
2008/0173159 A1* 7/2008 Chen ..... G10D 13/006 84/422.1

OTHER PUBLICATIONS

Latin Percussion, screen shot of http://www.lpmusic.com/products/Shakers/Maracas/Fusheki from Feb. 27, 2019.

* cited by examiner

*Primary Examiner* — Kimberly R Lockett

(57) ABSTRACT

A noise maker stop assembly for use with a percussion foot pedal is described. The noise maker stop assembly typically comprises a noise maker attached to an extended elongated shaft, mounting brackets, and a bumper or tension strap for rapidly stopping the extended elongated shaft. Typically, the mounting brackets may be coupled to an existing standard percussion or similar foot pedal. The mounting brackets may also be configured so as to be coupled to a particular percussion foot pedal. A percussion foot pedal having an integrated noise maker stop assembly is also contemplated.

20 Claims, 13 Drawing Sheets

FIG. 3
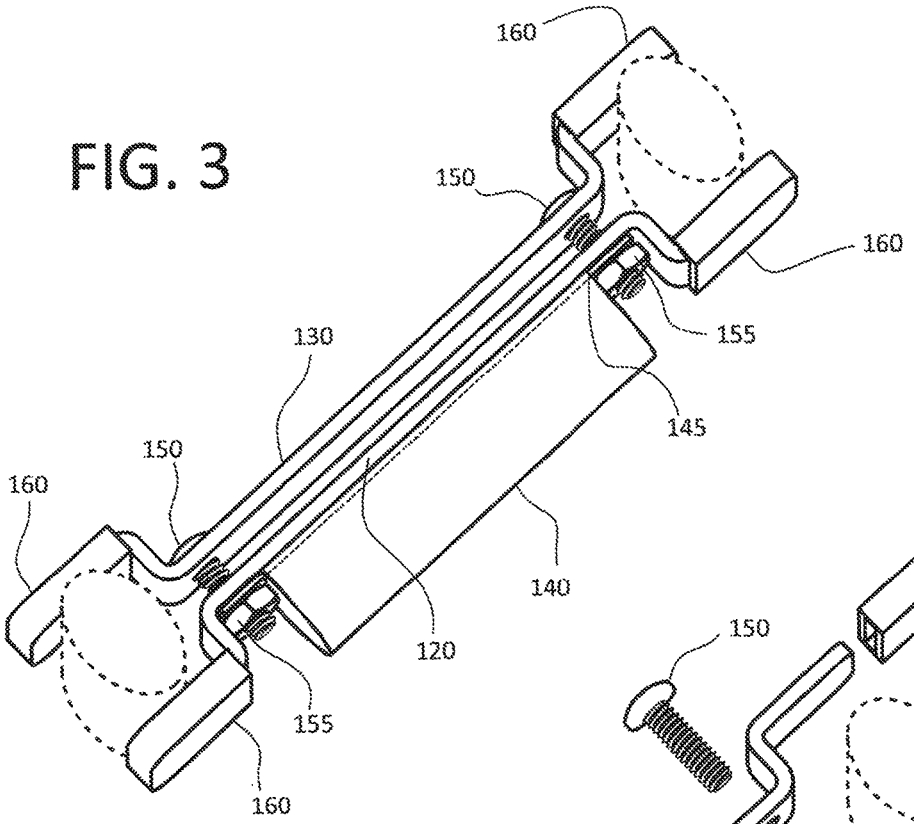
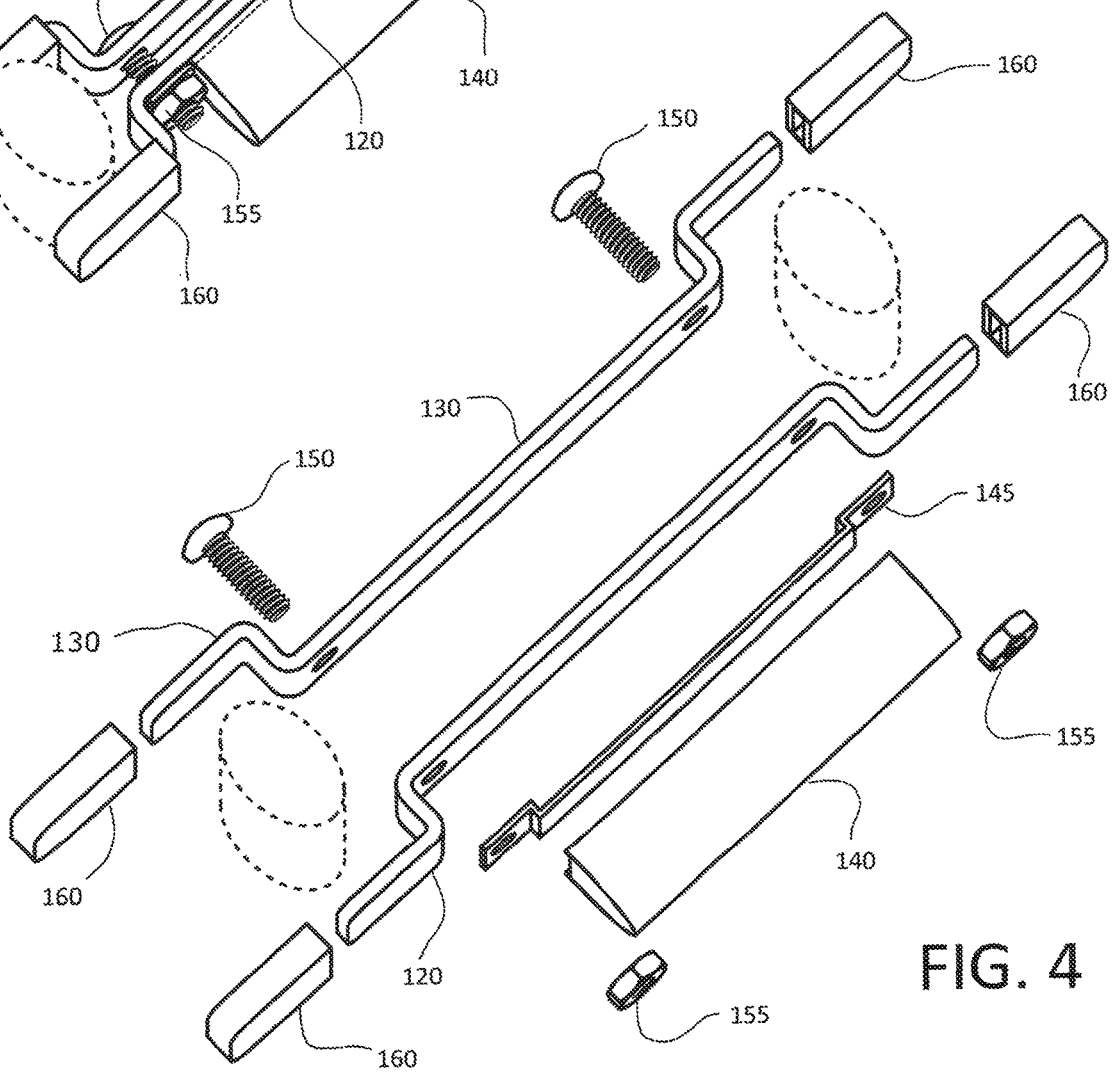
FIG. 4

FIG. 16
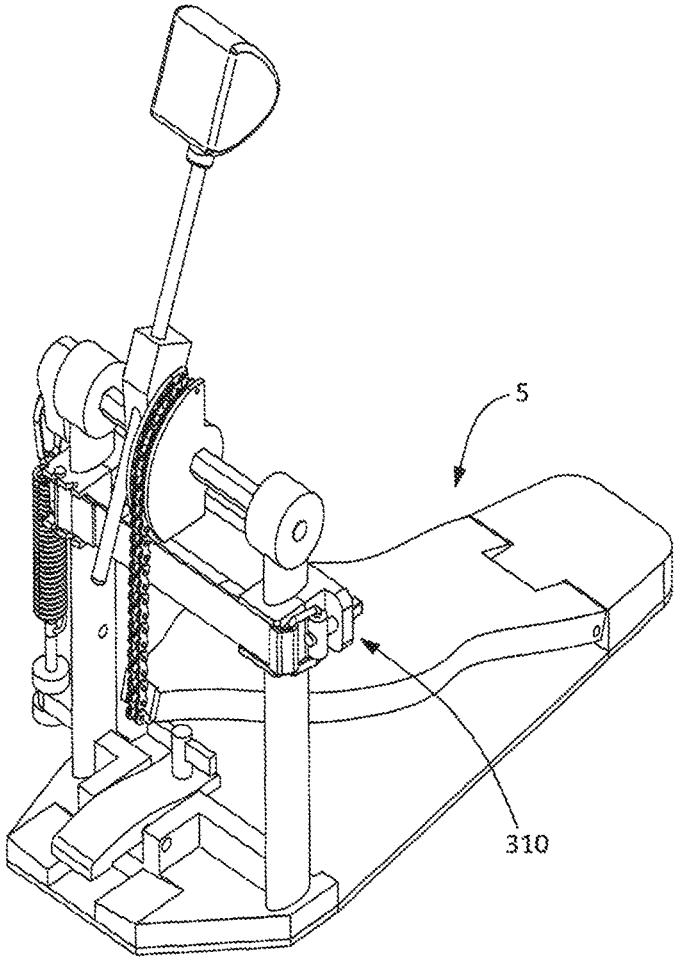
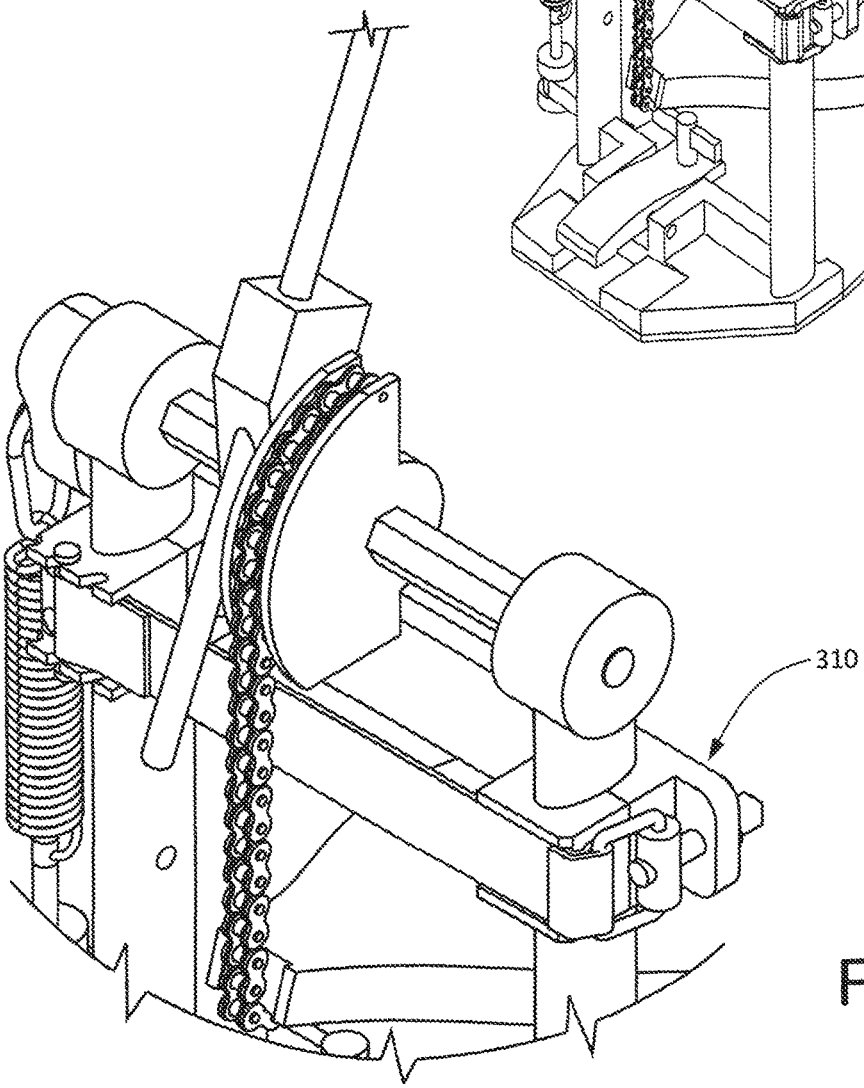
FIG. 17

NOISE MAKER STOP ASSEMBLY FOR USE WITH A PERCUSSION FOOT PEDAL

CROSS-REFERENCE TO RELATED APPLICATION

The present application claims the benefit of and priority to U.S. Provisional Patent Application No. 62/636,893, filed Mar. 1, 2018 and having the same inventor as the present application, the entire contents of which are hereby incorporated by reference.

BACKGROUND

Drum or percussion pedals are commonly used to actuate a mallet or "beater ball" into the head of a bass drum. On occasion, these pedals have been used for other purposes such as actuating a noise maker to which an elongated shaft has been attached. The elongated shaft is typically secured to the pedal in essentially the same manner in which a mallet or "beater ball" is secured to the pedal. When the foot pedal is depressed, a mechanical drive train is activated that results in the noise maker moving forward and generating a sound as it reaches the end of its forward travel. When pressure is removed from the pedal, the pedal is released, allowing the noise maker to travel in reverse and return to its resting position, generating a sound as it reaches the end of its reward travel. Successive depressing and releasing the foot pedal causes a back and forth motion of the noise maker and generates sound in the desired rhythm. Published application 20050109191 filed on Nov. 20, 2003 teaches a shaker for mounting on a percussion pedal as well as the combination of the shaker and the pedal.

Common usage of a noise maker is with handheld manipulated motion, creating various sound effects. Where the noise maker is a shaker or similar type device, one common sound effect is the precisely accented striking of the shaker shell's interior beads or other particulate against the striker shell wall as the shaker's motion is rapidly terminated. In the case of a common foot pedal actuated noise maker, the common foot pedal is not designed for rapid termination of motion other than when the mallet or "beater ball" comes into contact with the drum head. Therefore, to achieve rapid termination of the noise maker travel motion with a common foot pedal, another device must be incorporated, of which the foregoing prior art does not provide.

BRIEF DESCRIPTION OF THE DRAWINGS

FIG. 3 is a perspective view of a noise maker stop assembly with a bumper stopper according to an embodiment.

FIG. 4 is an exploded view of a noise maker stop assembly with a bumper stopper according to an embodiment.

FIG. 16 is a front perspective view of a noise maker stop assembly with a tension strap stopper and mounting brace mounted to a percussion foot pedal according to an embodiment.

FIG. 17 is a detail view of a noise maker stop assembly with a tension strap stopper and mounting brace mounted to a percussion foot pedal according to an embodiment.

DETAILED DESCRIPTION

Figure 1:
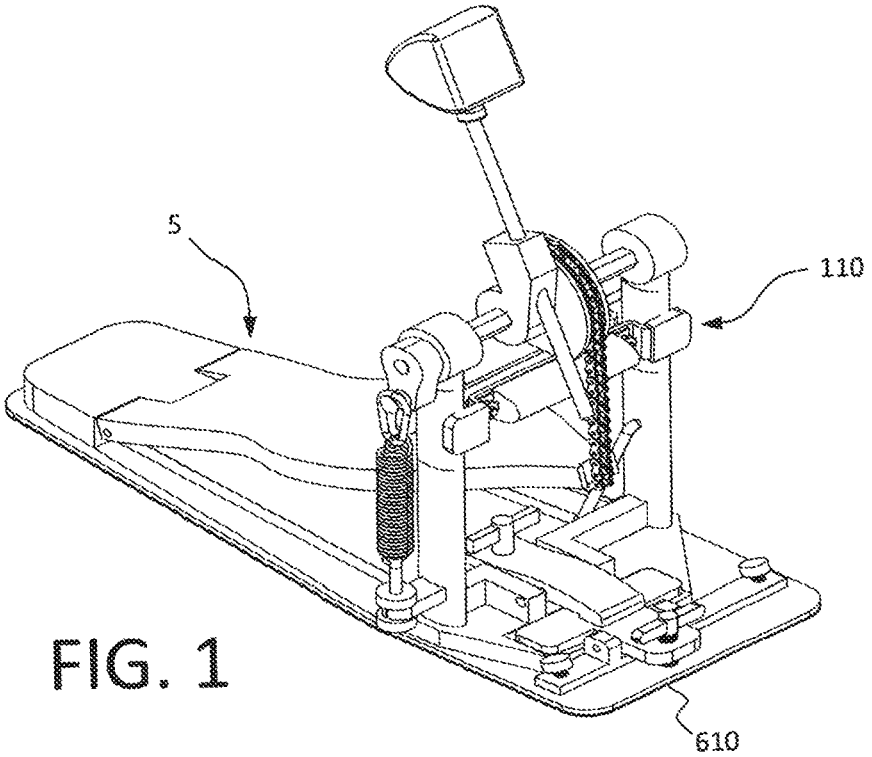
FIG. 1 is a front perspective view of a noise maker stop assembly with a bumper stopper mounted to a percussion foot pedal according to an embodiment.

Embodiments of the present invention comprise a noise maker attached to an extended elongated shaft and a stop assembly, both of which quickly and conveniently couple to a standard percussion pedal or similar pedal. The noise maker may comprise cymbals, castanets, shaker, or similar idiophone. The inertia of the movable elements of the noise maker, coupled with the controlled rapid stoppage of the extended elongated shaft as it comes into contact with the stopper component of the stop assembly, produces a more defined and desirable sound effect. Additionally, the stop assembly is constructed to dampen the sound generated by the extended elongated shaft impacting the stopper, allowing the noise makers' sound effect to be the predominate sound.

The extended elongated shaft is typically necessary to ensure that the shaft comes into contact with the stopper component of the stop assembly. The standard length of traditional elongated shafts used with a noise maker may often times be insufficient in length to ensure the necessary contact with the stopper.

The stop assembly is configured in such a way as to permit its use with most percussion foot pedals. The stop assembly is coupled to the foot pedal's vertical support columns, and is adjustable to accommodate vertical support columns of various circumferences and cross-sections. In some variations, the stop assembly comprises a front and back mounting bracket, and a stopper portion. Typically, the stopper portion of the stop assembly comprises a bumper mounted to a bumper bracket, and the stopper portion it typically attached to the front mounting bracket. The stopper portion may also be mounted to the back mounting bracket, if reversing the stop assembly is desired. In other variations, the stopper may be a tension strap. The tension strap is typically wrapped around the front and back mounting bracket, and secured in place with the desired rigidity by adjusting a turnbuckle tensioner. In other variations, the stop assembly may be custom fit to permit use with particular percussion pedals. In yet other variations, the stop assembly may be built into the frame of the foot pedal.

Some percussion pedals are structured in a way such that the pedal becomes unstable or wobbly when the pedal is not secured to a bass drum. In cases such as these, some variations of the present invention may include a stabilizing base plate. In some variations, the stabilizing base plate may include carpet spurs to allow the base plate to grip the carpet, ensuring the percussion pedal is stable and will stay in place. In other variations, the stabilizing base plate may include a non-skid friction pad.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "about," as used in this specification and appended claims, refers to plus or minus 20% of the value given.

The term "approximately," as used in this specification and appended claims, refers to plus or minus 10% of the value given.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "noise maker," as used in this specification and appended claims, refers to an instrument that generates a sound when engaged in motion, the stoppage of motion or struck, such as, but not limited to a block, a bell, a rattle, a jingle or a cymbal.

The terms "generally" and "substantially," as used in this specification and appended claims, mean mostly, or for the most part.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

Directional and/or relationary terms such as, but not limited to, left, right, nadir, apex, top, bottom, vertical, horizontal, back, front, longitudinal, and lateral are relative to each other and are dependent on the specific orientation of a applicable element or article, and are used accordingly to aid in the description of the various embodiments and are not necessarily intended to be construed as limiting.

A First Embodiment Noise Maker Stop Assembly

Figure 2:
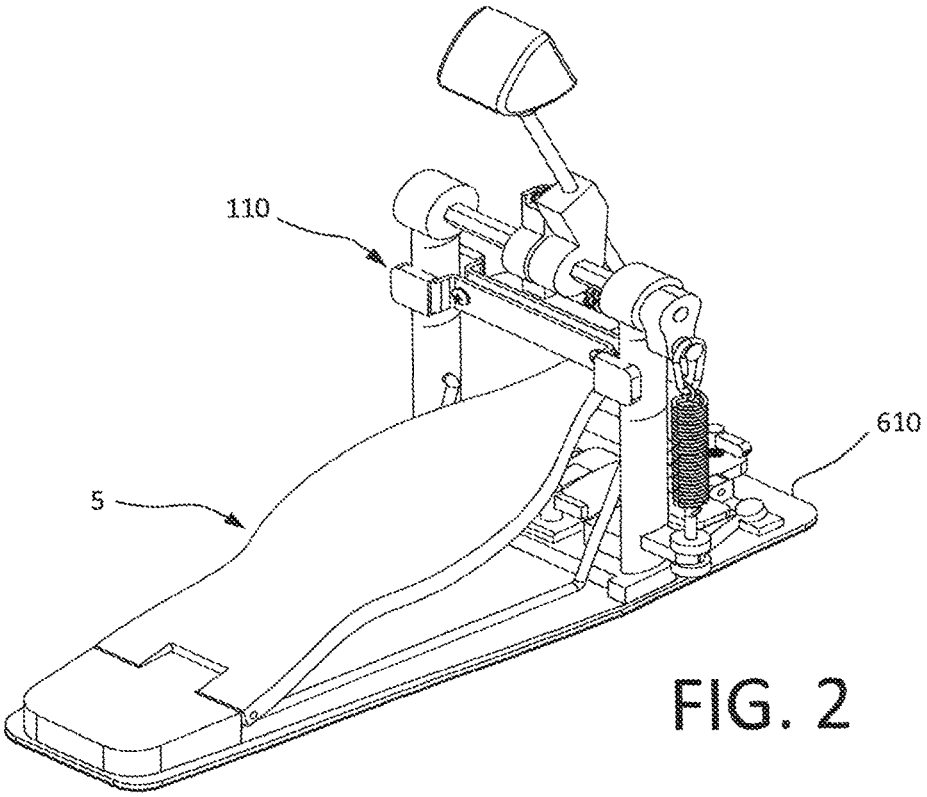
FIG. 2 is a back perspective view of a noise maker stop assembly with a bumper stopper mounted to a percussion foot pedal according to an embodiment.
Figure 5:
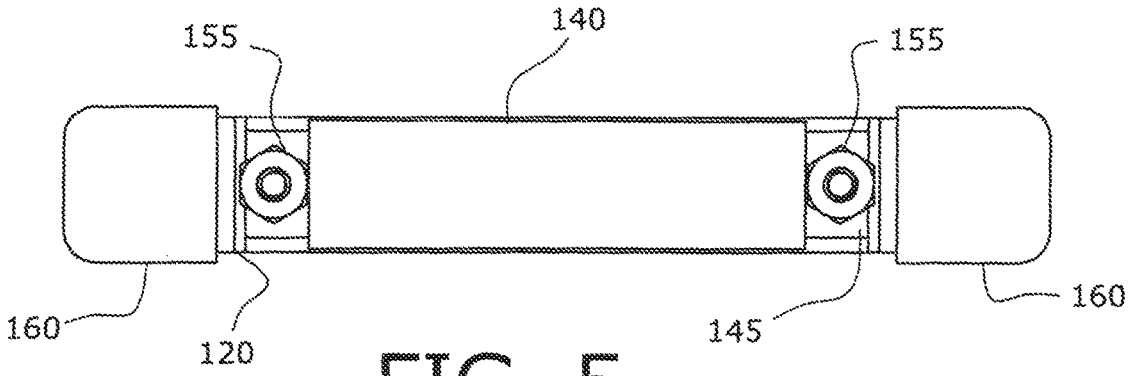
FIG. 5 is a side view of a noise maker stop assembly with a bumper stopper according to an embodiment.
Figure 7:
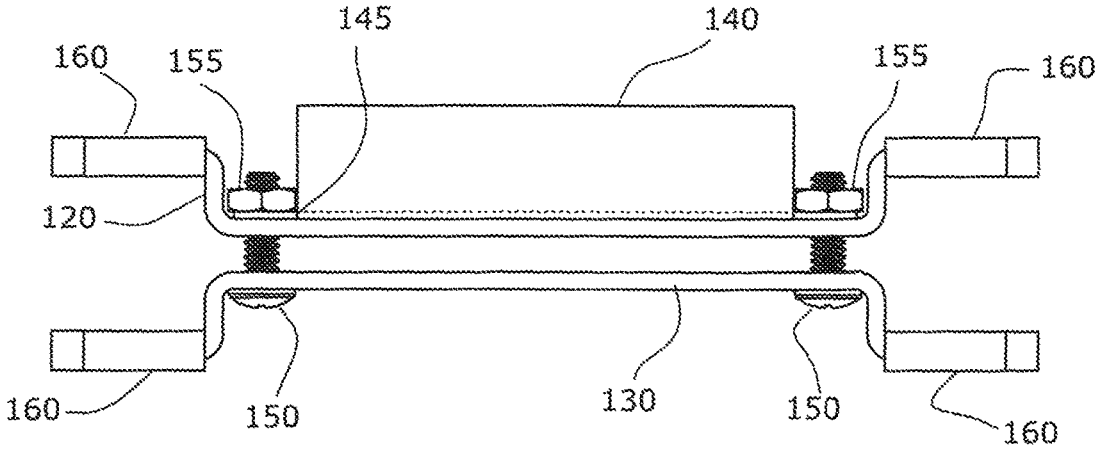
FIG. 7 is a top view of a noise maker stop assembly with a bumper stopper according to an embodiment.
Figure 6:
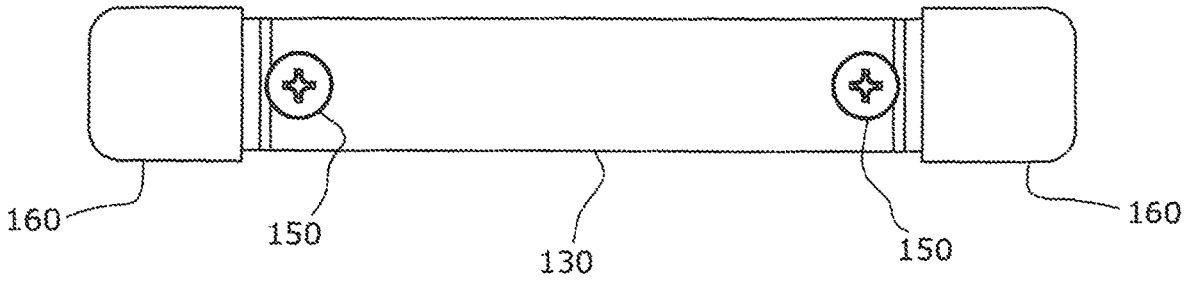
FIG. 6 is a side view of a noise maker stop assembly with a bumper stopper according to an embodiment.

A first embodiment noise maker stop assembly 110 is illustrated in FIGS. 1-10. Typically, the noise maker stop assembly 110 can include a front mounting bracket 120, a back mounting bracket 130, a bumper stopper 140, and a bumper bracket 145. The front mounting bracket 120 and the back mounting bracket 130 are structured and arranged in a manner as to enable the noise maker stop assembly 110 to be mounted between the left and right vertical support columns of a foot pedal, such as a percussion foot pedal 5. A first embodiment noise maker stop assembly 110 mounted to a percussion foot pedal 5 is illustrated in FIGS. 1 and 2.

Each of the front mounting bracket 120 and the back mounting bracket 130 are typically structured and arranged for holding a bumper stopper 140 secured to a bumper bracket 145. The bumper stopper 140 is typically secured to the bumper bracket 145 with an adhesive. In other variations, the bumper stopper 140 may be molded onto the bumper bracket 145. The bumper stopper 140 comprises a material that provides for the controlled rapid stop of an extended elongated shaft 190, while dampening the sound of the extended elongated shaft 190 coming into contact with the bumper stopper 140. Typically, the bumper stopper 140 comprises as an elastomeric material. In other variations, the bumper stopper 140 may comprise a plastic material.

The noise maker stop assembly 110 is typically mounted to a foot pedal by coupling the bumper bracket 145 to the front mounting bracket 120, and inserting a bracket bolt 150 through the front mounting bracket 120, the back mounting bracket 130, and the bumper bracket 145, and securing the bracket bolt 150 in place with a bracket nut 155. In other variations, the front mounting bracket 120 and the back mounting bracket 130 may be coupled magnetically. A protective sleeve 160 is typically placed over each end of the front mounting bracket 120 and the back mounting bracket 130 to prevent slippage of the stop assembly 110 once mounted to the foot pedal's vertical support columns. The protective sleeve 160 typically comprises an elastomeric material. In other variations, the protective sleeve 160 may comprise silicone material.

Figure 9:
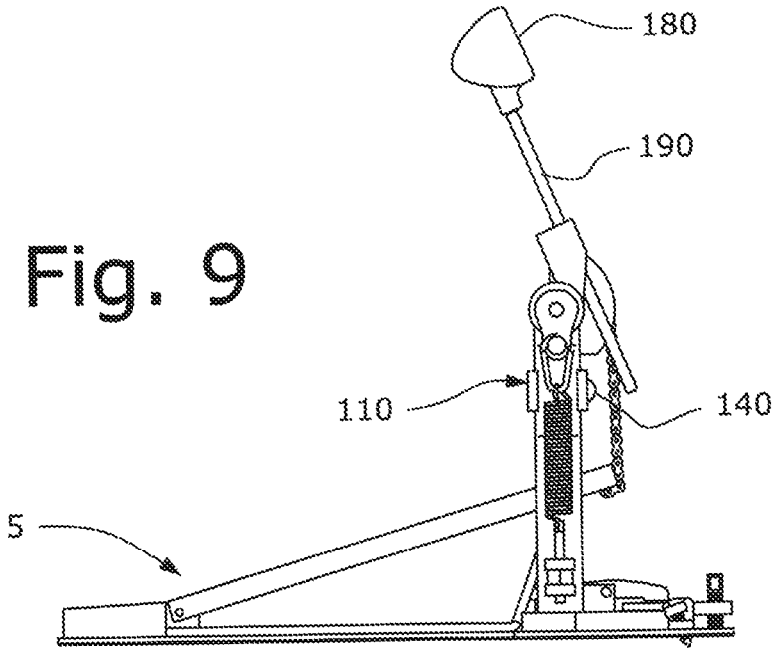
FIG. 9 is a side view of a noise maker stop assembly with a bumper stopper mounted to a percussion foot pedal according to an embodiment.
Figure 10:
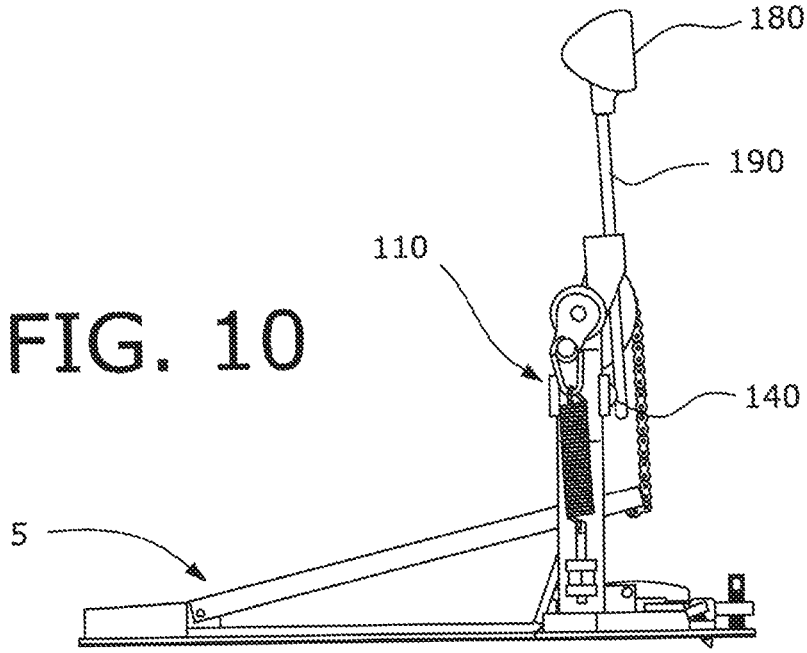
FIG. 10 is a side view of a noise maker stop assembly with a bumper stopper mounted to a Percussion foot pedal according to an embodiment.
Figure 25:
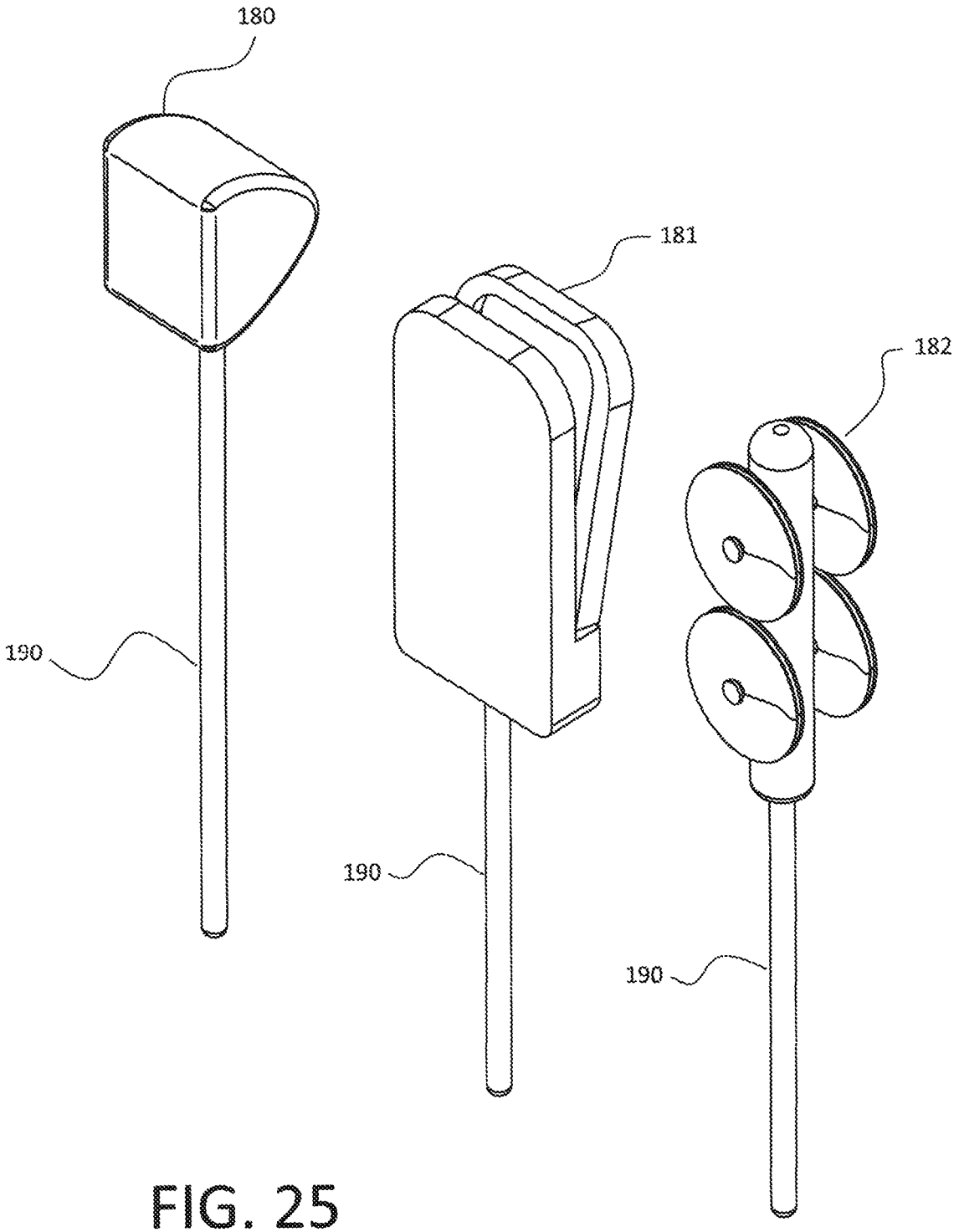
FIG. 25 is a perspective view of a noise maker with an extended elongated shaft according to another embodiment.

The noise maker 180-182 is preferably attached to an extended elongated shaft 190. The extended elongated shaft 190 is then inserted into the stem holder or similar component of the foot pedal. As illustrated in FIG. 25, the noise maker 180-182 may comprise a shaker 180, castanet 181, cymbals 182, or any similar instrument. As illustrated in FIG. 9, when the foot pedal is not depressed, the distal end of the extended elongated shaft 190 is positioned away from the noise maker stop assembly 110. As illustrated in FIG. 10, when the foot pedal is depressed, a mechanical drive train or similar mechanism is activated, causing the distal end of the extended elongated shaft 190 to travel towards and eventually come into contact with the noise maker stop assembly 110. Successive depressing and releasing the foot pedal causes a back and forth motion of the noise maker 180-182, and the controlled rapid stoppage of the distal end of the extended elongated shaft 190 as it comes into contact with the bumper stopper 140 of the noise maker stop assembly 110 enables the noise maker 180 to generate the desired sound in the desired rhythm.

A Second Embodiment Noise Maker Stop Assembly

Figure 11:
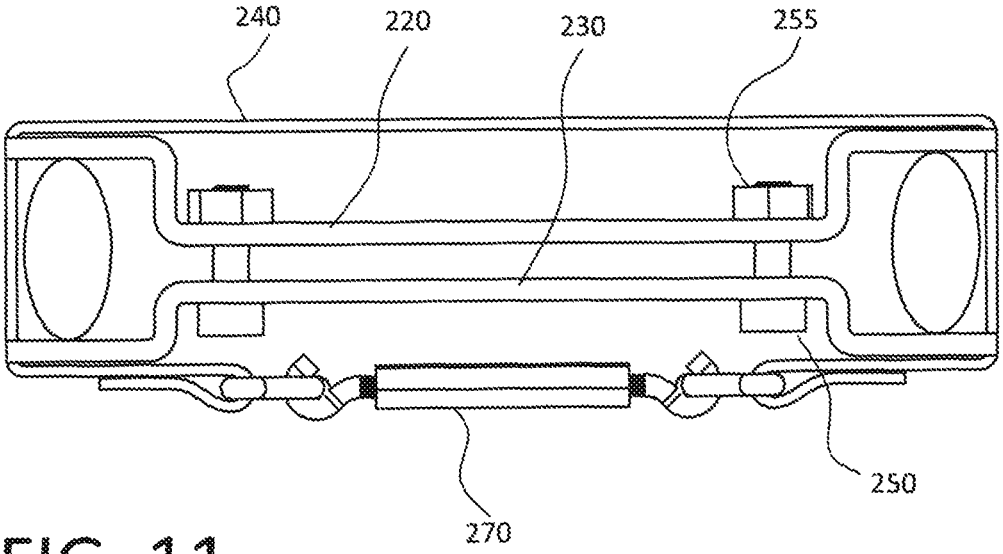
FIG. 11 is a top view of a noise maker stop assembly with a tension strap stopper according to an embodiment.
Figure 12:
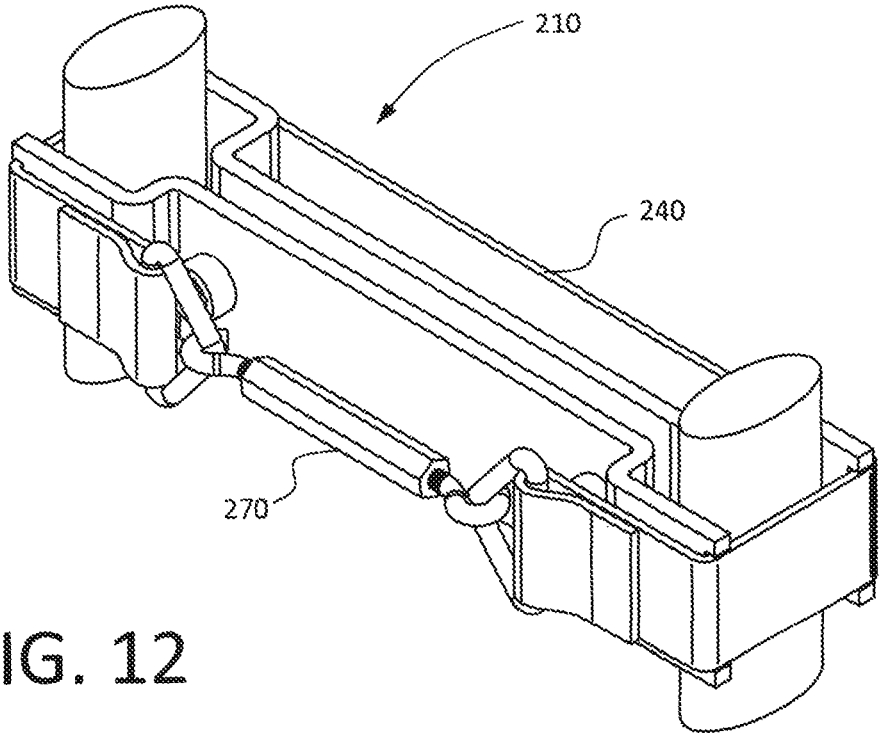
FIG. 12 is a perspective view of a noise maker stop assembly with a tension strap stopper according to an embodiment.
Figure 15:
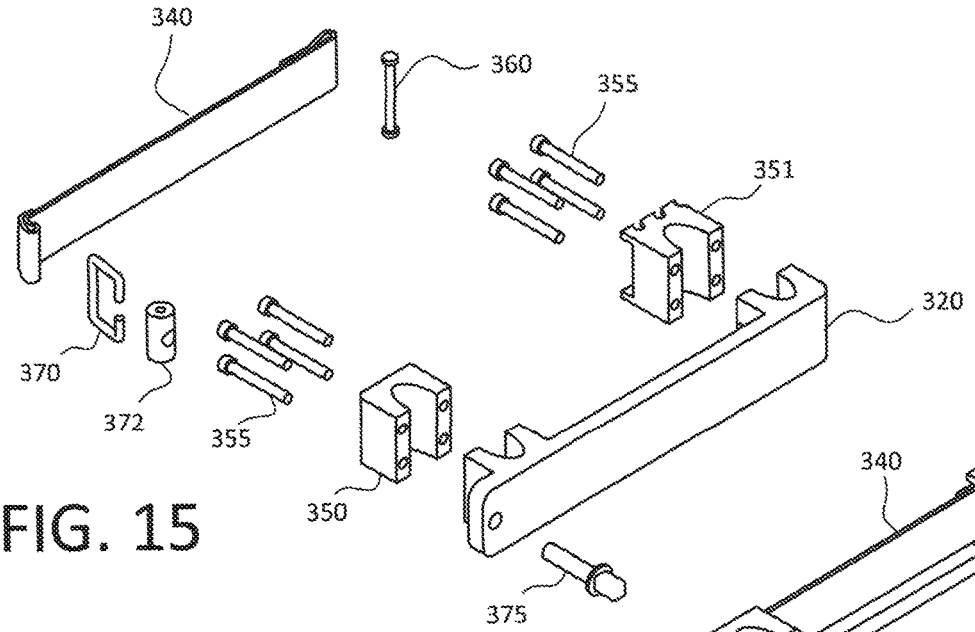
FIG. 15 is an exploded view of a noise maker stop assembly with a tension strap stopper and mounting brace according to an embodiment.
Figure 14:
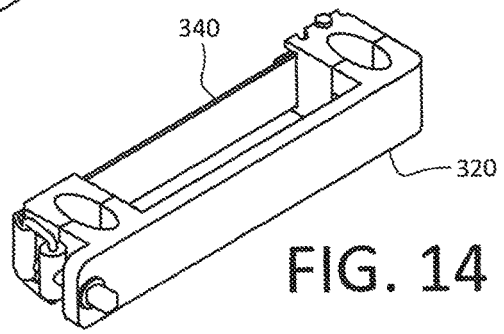
FIG. 14 is a perspective view of a noise maker stop assembly with a tension strap stopper and mounting brace according to an embodiment.
Figure 13:
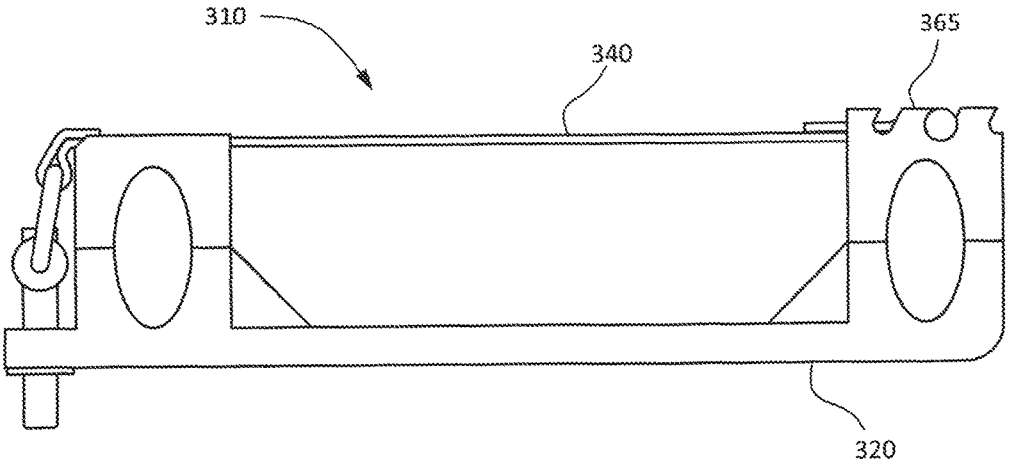
FIG. 13 is a top view of a noise maker stop assembly with a tension strap stopper and mounting brace according to an embodiment.

A second embodiment noise maker stop assembly 210 is illustrated in FIGS. 11 and 12. Typically, the second embodiment noise maker stop assembly 210 can include a front mounting bracket 220, a back mounting bracket 230, a tension strap stopper 240, and a tension adjuster 270. The front mounting bracket 220 and the back mounting bracket 230 are structured and arranged in a manner as to be coupled and mounted between the left and right vertical support columns of a foot pedal, such as a percussion foot pedal. Similar to the first embodiment, the front mounting bracket 220 is typically coupled to the back mounting bracket 230 with bracket bolts 250 and bracket nuts 255. In other variations, the front mounting bracket 220 and the back mounting bracket 230 may be coupled magnetically.

Once mounted, a tension strap stopper 240 is wrapped around the coupled mounting brackets, and secured in place with a tension adjuster 270. The tension strap stopper 240 typically comprises a nylon webbing material. The tension adjuster 270 typically comprises a turnbuckle tensioning system. The tension adjuster 270 may be adjusted as needed to provide the necessary tension or resistance of the tension strap stopper 240 to effectuate the desired sound when the distal end of the extended elongated shaft 190 comes into contact with the tension strap stopper 240 of the second embodiment noise maker stop assembly 210.

Typically, the noise maker 180-182 is attached to an extended elongated shaft 190. The extended elongated shaft 190 is then inserted into the stem holder or similar component of the foot pedal. When the foot pedal is not depressed, the distal end of the extended elongated shaft 190 is positioned away from the noise maker stop assembly 210. When the foot pedal is depressed, a mechanical drive train or similar mechanism is activated, causing the distal end of the extended elongated shaft 190 to travel towards and eventually come into contact with the noise maker stop assembly 210. Successive depressing and releasing the foot pedal causes a back and forth motion of the noise maker 180-182, and the controlled rapid stoppage of the distal end of the extended elongated shaft 190 as it comes into contact with the tension strap stopper 240 of the noise maker stop assembly 210 enables the noise maker 180-182 to generate the desired sound in the desired rhythm.

A Third Embodiment Noise Maker Stop Assembly

A third embodiment noise maker stop assembly 310 is illustrated in FIGS. 13-17. Typically, the third embodiment noise maker stop assembly 310 can include a mounting brace 320 and a tension strap stopper 340. The mounting brace 320 is structured and arranged in a manner as to enable its mounting to the left and right vertical support columns of a known circumference or size. A third embodiment noise maker stop assembly 310 mounted to a percussion foot pedal is illustrated in FIGS. 16 and 17.

The mounting brace 320 is mounted between the vertical support columns by coupling the first side of the mounting brace 320 and the left mounting piece 350 so as to enclose the left vertical support column therein, and coupling the second side of the mounting brace 320 and the right mounting piece 351 so as to enclose the right vertical support column therein. Each of the left mounting piece 350 and the right mounting piece 351 are secured to the mounting brace 320 with mounting screws 355.

Each of the first and second end of the tension strap stopper 340 comprise a sleeve for holding a securing mechanism therein. Typically, a securing pin 360 is inserted into the sleeve of the first end of the tension strap stopper 340, and received into a tension adjustment slot 365. The right mounting piece 351 typically has a plurality of tension adjustment slots 365, allowing for the rigidity of the tension strap stopper 340 to be adjusted as desired. A c-ring 370 is inserted into the sleeve of the second end of the tension strap stopper 340 and then coupled with a barrel nut 375. A barrel bolt 372 is threaded through the second side of the mounting brace 320 and the barrel bolt 372, securing the tension strap stopper 340 in place.

Typically, the noise maker 180-182 is attached to an extended elongated shaft 190. The extended elongated shaft 190 is then inserted into the stem holder or similar component of the foot pedal. When the foot pedal is not depressed, the distal end of the extended elongated shaft 190 is positioned away from the noise maker stop assembly 310. When the foot pedal is depressed, a mechanical drive train or similar mechanism is activated, causing the distal end of the extended elongated shaft 190 to travel towards and eventually come into contact with the noise maker stop assembly 310. Successive depressing and releasing the foot pedal causes a back and forth motion of the noise maker 180-182, and the controlled rapid stoppage of the distal end of the extended elongated shaft 190 as it comes into contact with the tension strap stopper 340 of the noise maker stop assembly 310 enables the noise maker 180-182 to generate the desired sound in the desired rhythm.

A Fourth Embodiment Noise Maker Stop Assembly

Figure 19:
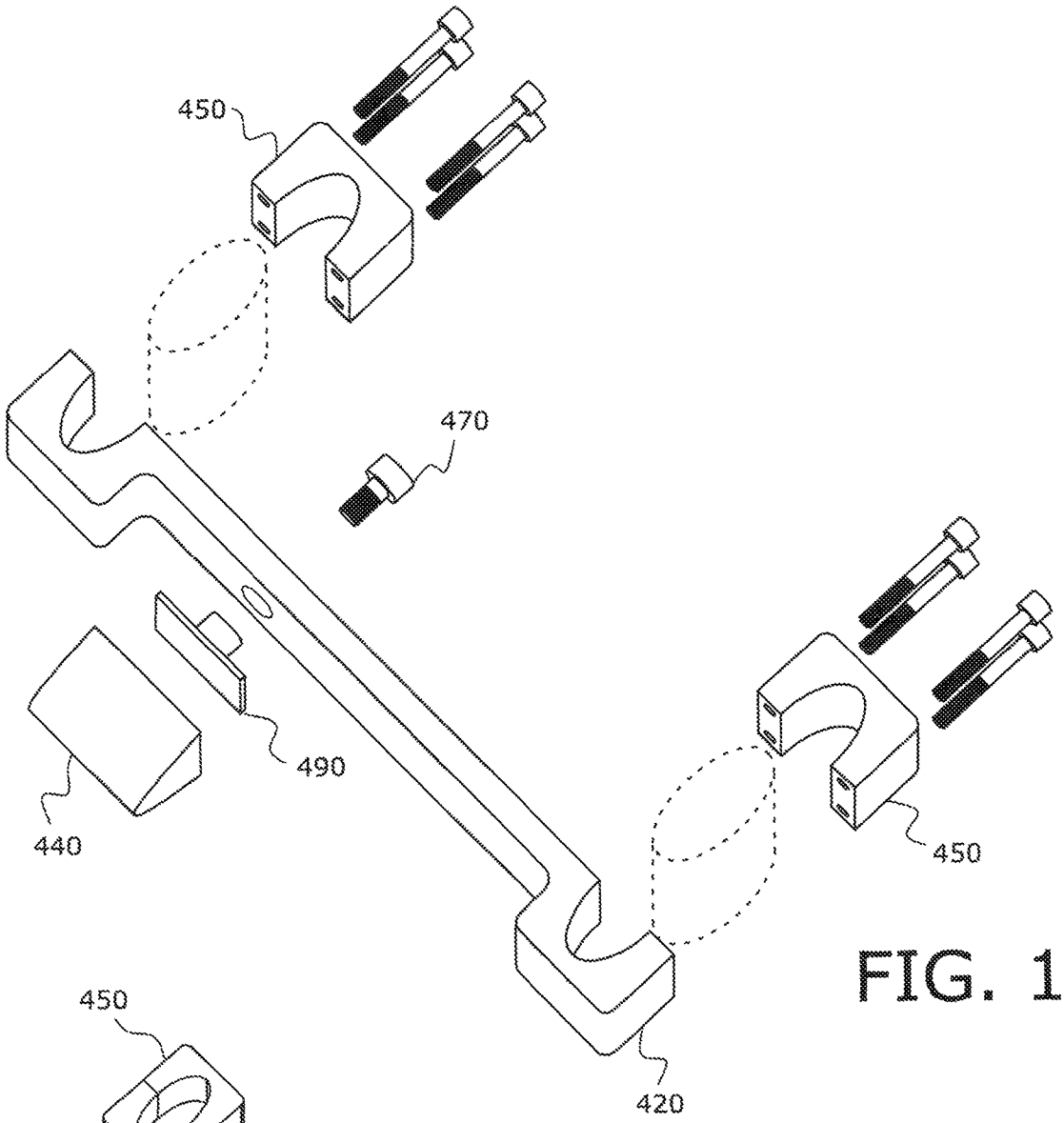
FIG. 19 is an exploded view of a noise maker stop assembly with a mounting brace and bumper stopper according to an embodiment.
Figure 18:
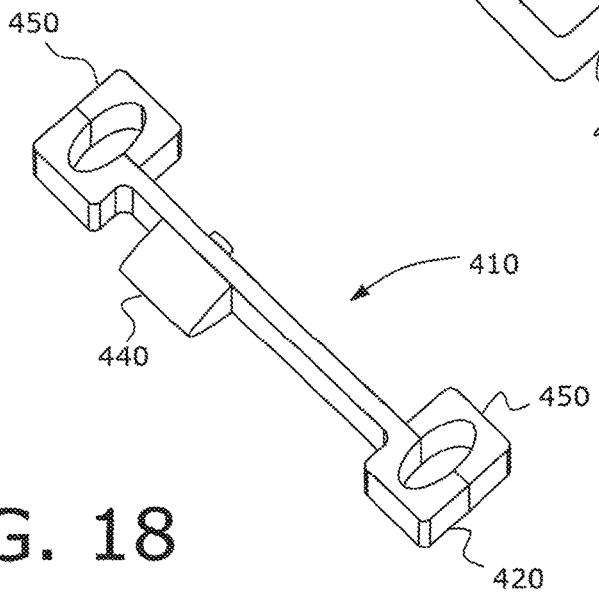
FIG. 18 is a perspective view of a noise maker stop assembly with a mounting brace and bumper stopper according to an embodiment.

A fourth embodiment noise maker stop assembly 410 is illustrated in FIGS. 18 and 19. Typically, the fourth embodiment noise maker stop assembly 410 can include a mounting brace 420, a bumper stopper 440, and a first and second mounting piece 450. The mounting brace 420 is structured and arranged in a manner as to enable its mounting to the left and right vertical support columns of a known circumference or size.

The mounting brace 420 is mounted between the vertical support columns by coupling a first side of the mounting brace 420 to a first mounting piece 450 so as to enclose the left vertical support column therein, and coupling a second side of the mounting brace 420 to a second mounting piece 450 so as to enclose the right vertical support column therein. Each of the first and second mounting piece 450 are secured to the mounting brace 420 with mounting screws 455. In another variation, the mounting brace 420 and the first and second mounting piece 450 may be coupled magnetically.

The bumper stopper 440 is typically coupled to a bumper mount 490, which is coupled to the mounting brace 420 by inserting a bumper mounting bolt 470 through the mounting brace 420, and into the bumper mount 490. The bumper stopper 440 is preferably secured at a position so as to generally vertically align the bumper stopper 440 with the stem mount of the foot pedal. Similar to the first embodiment, the bumper stopper 440 comprises a material that provides for the controlled rapid stop of an extended elongated shaft 190, while dampening the sound of the extended elongated shaft 190 coming into contact with the bumper stopper 440. Typically, the bumper stopper 440 comprises as an elastomeric material. In other variations, the bumper stopper 440 may comprise a plastic material.

An Embodiment of a Foot Pedal with Integrated Noise Maker Stop Assembly

Figure 20:
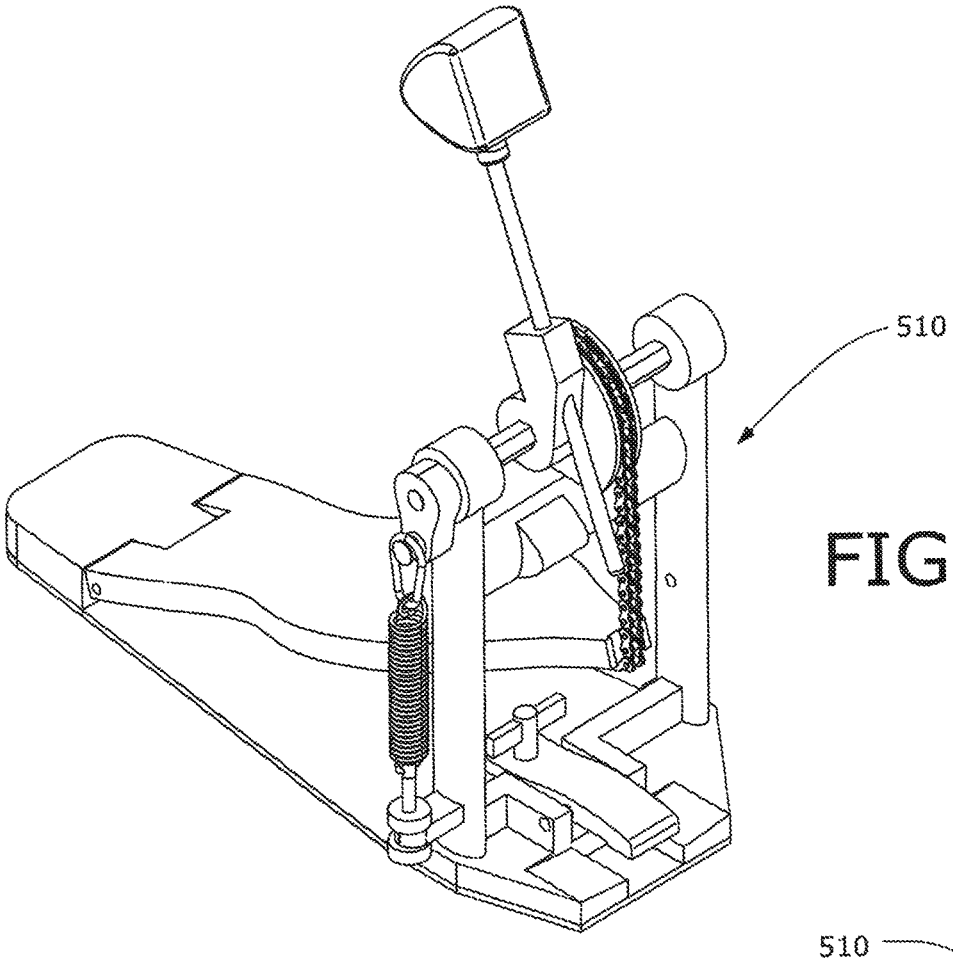
FIG. 20 is a perspective view of a percussion foot pedal having an integrated noise maker stop assembly according to an embodiment.
Figure 21:
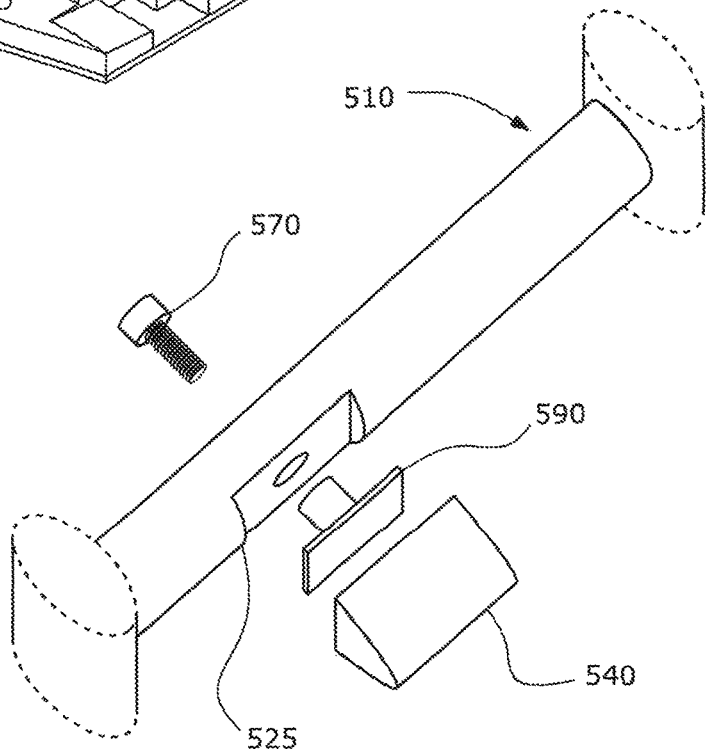
FIG. 21 is an exploded view of an integrated noise maker stop assembly according to an embodiment.

An embodiment of foot pedal with integrated noise maker stop assembly 510 is illustrated in FIGS. 20 and 21. Typically, a foot pedal with integrated noise maker stop assembly 510 can include a stop mount bar 525 and a bumper stopper 540. The stop mount bar 525 is integrated into a percussion foot pedal or similar pedal. A percussion foot pedal having an integrated noise maker stop assembly 510 is illustrated in FIG. 19.

The bumper stopper 540 is typically coupled to the bumper mount 590, which is coupled to the stop mount bar 525 by inserting a bumper mounting bolt 570 through the stop mount bar 525, and into the bumper mount 590. The bumper stopper 540 is preferably secured at a position so as to generally vertically align the bumper stopper 540 with the stem mount of the foot pedal. Similar to the first and fourth embodiments, the bumper stopper 540 comprises a material that provides for the controlled rapid stop of an extended elongated shaft 190, while dampening the sound of the extended elongated shaft 190 coming into contact with the bumper stopper 540. Typically, the bumper stopper 540 comprises as an elastomeric material. In other variations, the bumper stopper 540 may comprise a plastic material.

An Embodiment of a Stabilizing Base Plate Assembly

Figure 8:
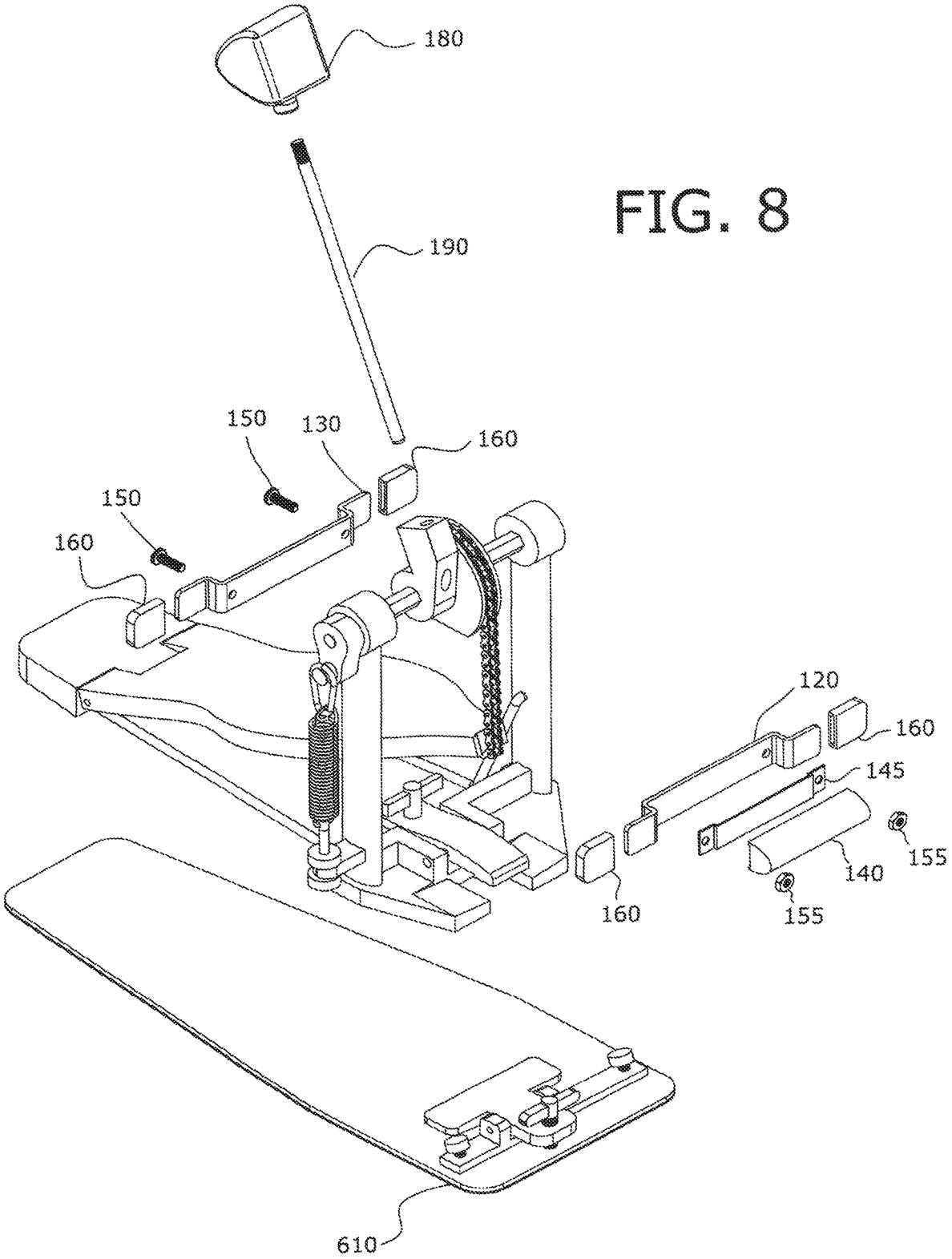
FIG. 8 is an exploded view of a noise maker stop assembly with a bumper stopper mounted to a percussion foot pedal with a stabilizing base plate according to an embodiment.
Figure 22:
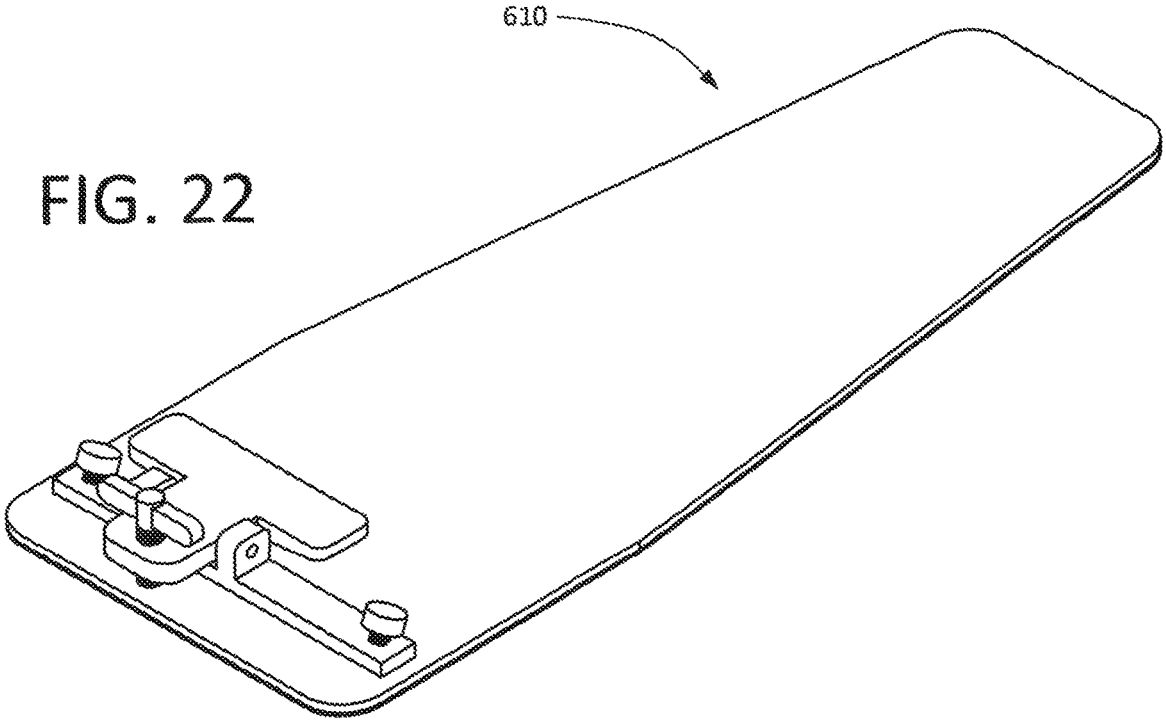
FIG. 22 is a front perspective view of a stabilizing base plate assembly according to an embodiment.
Figure 23:
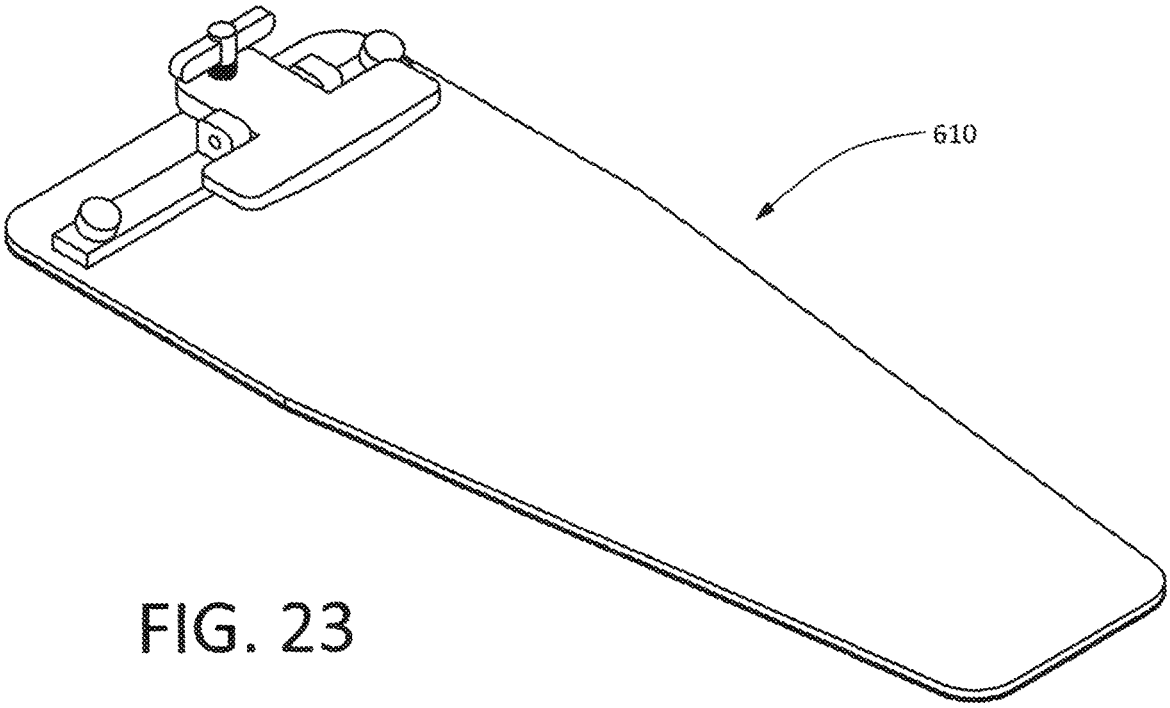
FIG. 23 is a rear perspective view of a stabilizing base plate assembly according to an embodiment.
Figure 24:
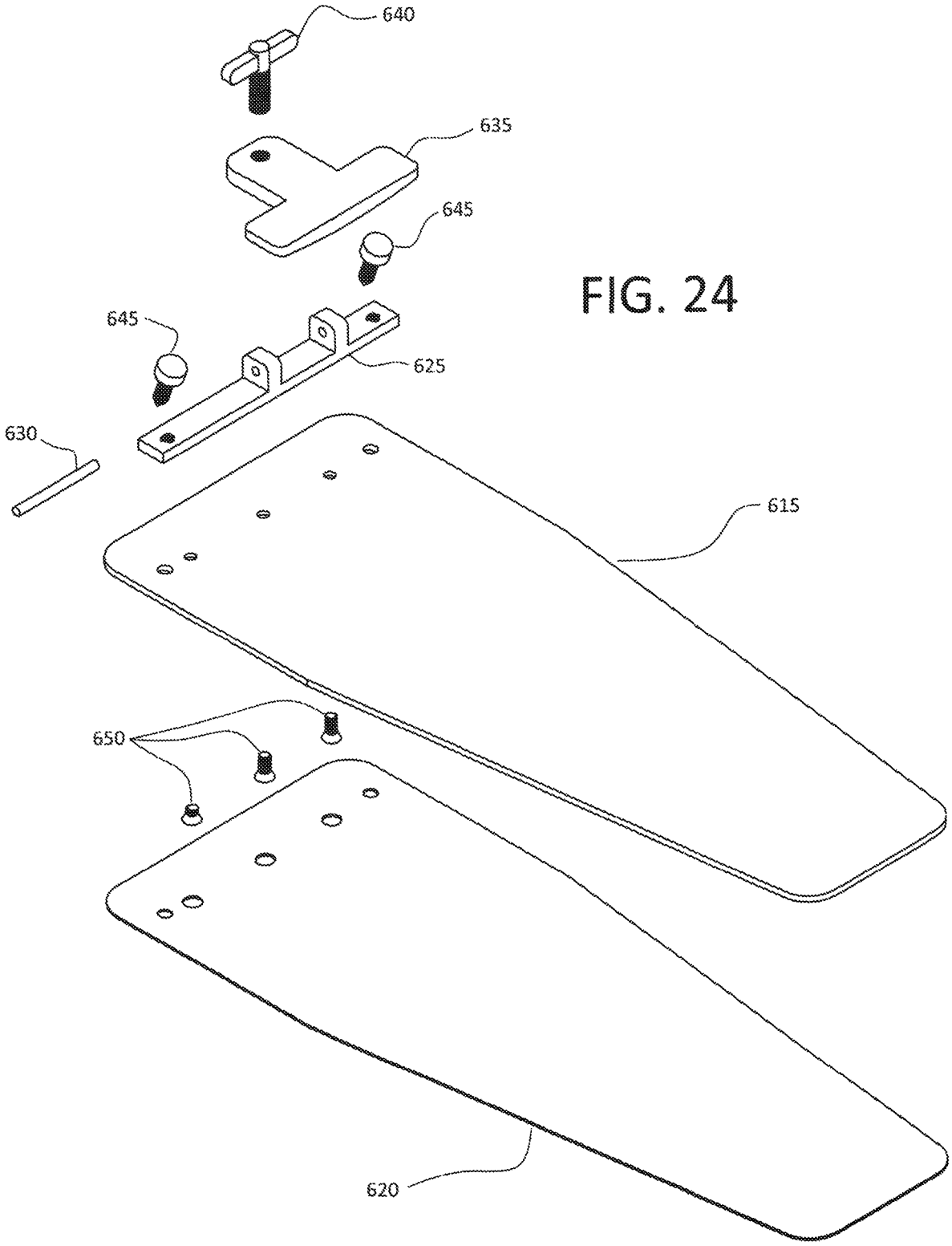
FIG. 24 is a dissembled view of a stabilizing base plate assembly according to an embodiment.

An embodiment of a stabilizing base plate assembly 610 is illustrated in FIGS. 22-24. The stabilizing base plate assembly 610 can be used in conjunction with any of the aforementioned embodiments. The stabilizing base plate assembly 610 typically comprises a base plate 615, a friction pad 620, a hinge plate 625, a hinge pin 630, a base plate clamp 635, a clamp adjustment bolt 640, carpet spurs 645, and hinge plate mounting screws 650. A stabilizing base plate assembly 610 mounted to a percussion foot pedal is illustrated in FIGS. 1 and 8.

The clamp adjustment bolt 640 is threaded into the base plate clamp 635. The base plate clamp 635 is secured to the hinge plate 625 by inserting the hinge pin 630 through the hinge plate 625 and the base plate clamp 635. The hinge plate 625 is secured to the base plate 615 by threading the hinge plate mounting screws 650 through the base plate 615 and into the hinge plate 625. The stabilizing base plate assembly 610 is mounted to a percussion foot pedal by clamping the base plate clamp 635 to the percussion foot pedal, and securing the base plate clamp 635 in place with the clamp adjustment bolt 640.

The friction pad 620 is secured underneath the base plate 615. The friction pad 620 typically comprises a non-skid material. When desired, carpet spurs 645 may be threaded through the hinge plate 645 to enable the stabilizing base plate assembly 610 to grip carpet or a similar floor surface.

Alternative Embodiments and Variations

The various embodiments and variations thereof, as illustrated in the accompanying Figures or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

What I claim is:

1. A noise maker stop assembly for mounting to a foot pedal having a noise maker with an extended elongated shaft having a distal end received in a stem holder of the foot pedal, the noise maker stop assembly being configured for attachment to generally parallel and vertical support columns of the foot pedal, and including a stopper configured to stop the forward motion of the noise maker when mounted to the foot pedal and the distal end of extended elongated shaft is pivoted into the stopper.

2. The noise maker stop assembly of claim 1 in combination with the noise maker.

3. The combination of claim 2 further including the foot pedal.

4. The noise maker stop assembly of claim 1, wherein the stopper comprises an elastomeric bumper.

5. The noise maker stop assembly of claim 1, wherein the stopper comprises a tensioned strap.

6. The combination of claim 2 further including a stabilizing base plate assembly, the stabilizing base plate assembly including a base plate and a base plate clamp located proximate a front end of the base plate, the base plate clamp being configured for attachment to a bass drum clamp on the foot pedal.

7. The combination of claim 6 further including the foot pedal.

8. The combination of claim 2, wherein the noise maker comprises one of a shaker, one or more cymbals, and a castanet.

9. A combination for the retrofit of a percussion foot pedal having a stem holder and a pair of generally parallel and vertical support columns, the combination comprising:

a noise maker assembly including a noise maker and an extended elongated shaft, the extended elongated shaft having a proximal end configured to attach to the noise maker, and being configured for receipt into the stem holder of the foot pedal with a distal end passing through the stem holder; and a stop assembly including (i) a stopper for stopping the forward motion of the noise maker when the distal end of the elongated shaft is pivoted into the stopper, and (ii) one or more mounting brackets, the stopper being secured to the one or more mounting brackets and the one or more mounting brackets being configured for attachment to the vertical support columns.

10. The combination of claim 9 further including a stabilizing base plate assembly, the stabilizing base plate including a base plate and a base plate clamp located proximate a front end of the base plate, the base plate clamp being configured for attachment to a bass drum clamp on the foot pedal.

11. The combination of claim 9, wherein the extended elongated shaft is at least 5 inches long.

12. The combination of claim 9, wherein the stopper comprises an elastomeric bumper.

13. The combination of claim 9, wherein the stopper comprises a tensioned fabric strap.

14. The combination of claim 9, wherein the one or more brackets comprise at least a front bracket and a rear bracket, the stopper being attached to the front bracket, and each bracket including left and right ends with the respective left and right ends being configured to clamp to the vertical support columns when coupled together with one or more threaded fasteners.

15. The combination of claim 9 further comprising the foot pedal wherein the extended elongated shaft is received in the stem holder with the distal end being located below the stem holder, and the one or more mounting brackets are attached to the vertical support columns.

16. The combination of claim 10 further comprising the foot pedal wherein (a) the extended elongated shaft is received in the stem holder with the distal end being located below the stem holder, (b) the one or more mounting brackets are attached to the vertical support columns, and (c) the stabilizing base plate assembly is attached to a bottom of the foot pedal by way of the base plate clamp.

17. A percussion foot pedal assembly including (i) a percussion foot pedal having at least a foot pedal, a pivoting stem holder operatively coupled to the foot pedal for pivotal movement when the foot pedal is actuated, a pair of vertical support columns for supporting the stem holder, and a base, (ii) a noise maker assembly with a noise maker and an extended elongated shaft with the elongated shaft received in the stem holder with a distal end of the extended elongated shaft extending significantly below the stem holder, and (iii) a stopper attached to the vertical support columns by way of one or more brackets or a stop mount bar attached to and spanning the vertical support columns at a location below the stem holder, wherein the distal end of the stem holder impacts the stopper when the noise maker is pivoted by way of the stem holder.

18. The percussion foot pedal assembly of claim 17 further including a stabilizing base plate assembly, the stabilizing base plate assembly being removably coupled to the base of the percussion foot pedal.

19. A method of using the percussion foot pedal assembly of claim 17, the method comprising:

depressing the foot pedal to rotate the pivoting stem holder and the associated noise maker forwardly; and the distal end of the extended elongated shaft impacting the stopper to stop the forward rotational motion of the noise maker.

20. The method of claim 19 further comprising:

releasing the foot pedal causing the pivoting stem holder and the associated noise maker to rotate rearwardly to a resting position.

* * * * *